United States Patent [19]

Foley et al.

[11] Patent Number: 4,731,633

[45] Date of Patent: Mar. 15, 1988

[54] ELIMINATION OF STREAMER FORMATION IN POSITIVE CHARGING CORONA DEVICES

[75] Inventors: Geoffrey M. T. Foley; Roger W. LaForce, both of Fairport; Conrad J. Bell, Webster; Thomas W. Cherry, Macedon, all of N.Y.

[73] Assignee: Xerox Corporation, Stamford, Conn.

[21] Appl. No.: 43,075

[22] Filed: Apr. 27, 1987

[51] Int. Cl.[4] ..... G03G 15/02

[52] U.S. Cl. ..... 355/3 CH; 355/14 CH; 355/77; 430/902; 361/225

[58] Field of Search ..... 355/3 CH, 3 R, 14 CH, 355/77; 361/225, 230; 250/324–326; 430/31, 35, 902

[56] References Cited

U.S. PATENT DOCUMENTS

| | | | |
|---|---|---|---|
| 2,777,957 | 1/1957 | Walkup | 250/49.5 |
| 2,879,395 | 3/1959 | Walkup | 250/49.5 |
| 3,076,092 | 1/1963 | Mott | 250/49.5 |
| 3,370,212 | 2/1968 | Frank | 317/262 |
| 3,390,266 | 6/1968 | Epping | 250/49.5 |
| 3,800,154 | 3/1974 | Tanaka | 250/326 |
| 4,234,249 | 11/1980 | Weikel et al. | 355/3 CH |
| 4,306,271 | 12/1981 | Weber | 361/229 |
| 4,339,783 | 7/1982 | Kinashi et al. | 361/235 |
| 4,371,252 | 2/1983 | Uchida | 361/225 X |
| 4,456,365 | 6/1984 | Yuasa | 355/3 CH |
| 4,565,436 | 1/1986 | Okada et al. | 355/3 R |
| 4,672,505 | 6/1987 | Tsuchiya et al. | 355/3 CH |

*Primary Examiner*—R. L. Moses

*Attorney, Agent, or Firm*—Mark Costello

[57] ABSTRACT

Method and apparatus for applying a periodic negative voltage to a coronode for the prevention of a streaming phenomenon in electrographic devices. A negative polarity voltage signal is applied periodically to the bare wire coronode of a positive corona charging device. The negative polarity voltage signal is believed to prevent the formation of streamer sites associated with the pepper tracking copy quality defect. The negative polarity voltage signal is applied to the coronode in a manner having a minimal effect on charging functions.

16 Claims, 4 Drawing Figures

ELIMINATION OF STREAMER FORMATION IN POSITIVE CHARGING CORONA DEVICES

This invention relates generally to improving the operation of corona charging devices in electrographic applications such as xerography and ionography, and more particularly, to an arrangement which substantially reduces the copy quality defect referred to as "pepper tracking".

BACKGROUND OF THE INVENTION

In Carlson-type xerography, a photoreceptor comprising a layer of photoconductive insulating material deposited over a conductive substrate is used to support electrostatic latent images. The surface of the photoconductive material is electrostatically charged and exposed to a light pattern of an image to be reproduced, to selectively discharge the charged surface in accordance with the image. The undischarged areas of the surface form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Thus, a toner image is produced in conformity with a light image of the copy being reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals.

The photoconductive material in photoreceptors commonly used in xerographic devices often comprises selenium or its alloys. Charging of selenium-based photoreceptors commonly requires a positive charging corona device such as a corotron or scorotron driven with a positive D.C. voltage signal. In practice, the positive charging corona device comprises a strand of bare tungsten or oxidized tungsten wire forming a coronode supported between two insulating blocks, and driven at high D.C. voltage in the range of 3500–10,000 volts. The corona charging device is arranged closely adjacent to the surface of the photoreceptor and is designed so as to apply a uniform charge thereto. during relative movement of the photoreceptor and the corona charging device.

During operation of the positive charging corona device to charge the photoreceptor to a uniform voltage level, a copy quality defect known as "pepper tracking" is sometimes observed. Pepper tracking, as the name implies, is a copy quality defect which results in a large number of undesirable small spots in a narrow area forming a band across the copy sheet. The band or track generally occurs along a narrow path parallel to the direction of sheet travel. When pepper tracking is observed, it is sometimes seen with several such bands. The spots on the copy may be in the form of dark spots on a white background or white spots on a dark dusting. Both arise as a result of excessive deposition of positive ions in small localized regions on the photoreceptor. The source of this excess ion deposition is so called "hot spots" on the coronode. These hot spots represent local microscopic regions of the coronode which, for reasons which are poorly understood, emit bursts of positive ions in pulses or streamers which are on the order of microseconds in duration. They may be compared to an electrical arc which is self-limiting.

It is believed that the hot spots and the associated pepper tracking defects are primarily the result of operating the corona charging device in an environment in which certain kinds of contamination are present. Particularly, certain environmental conditions cause a defect in the bare wire coronodes commonly used in positive charging corona devices. The defect has been particularly observed in areas having a high contamination level of silicon-based contaminants, such as silicon oil vapor. Silicon-based contaminants are frequently encountered in the environment, and silicon oil vapor is pervasive in many xerographic machines in which silicon oil is used as a release agent on the fuser rolls. Under these conditions, a glassy-like substance, believed to be a silicon oxide, is observed to build up on the coronode in areas where the streamers are believed to originate. The build up often occurs in the form of defects on the coronode surface. Morphologically, these defects have the appearance of cones, whiskers and rosettes. Electrical arcing, or streamers, have been observed emanating from the areas adjacent to these defects. However, rather than burning a hole in the photoreceptor, the streamers produced by this condition appear to be self-limiting in life and end, usually before doing damage to the photoreceptor. The result is that a small area of excessive positive charge is present on the photoreceptor. In those areas of the photoreceptor not discharged during the exposure step, the excess charge levels are frequently high enough to cause breakdown to the magnetic brush development roll. This results in white spots on an otherwise dark area on the developed image. In those areas of the photoreceptor discharged to background potential, regions in which development of toner normally does not occur during the development step, the excess charge areas are insufficiently discharged to prevent development of a toned image and therefore dark spots are observed in these regions against an otherwise white background.

A typical service response to the pepper tracking defect is to replace the coronode wire in the corona charging device. This is time consuming, and necessarily expensive. In addition, there exist environments where the level of airborne contamination is sufficiently high that wire replacement serves to eliminate the pepper tracking problem for only a relatively short time. The use of platinum wire as a substitute for tungsten or oxidized tungsten may have minor beneficial effects in retarding the occurrence of pepper tracking, but its effectiveness is limited, and as a precious metal, it is expensive.

The pepper tracking defect is also observed as a problem in other positive charging applications where a corona charging device is used to apply a positive charge to a charge retentive surface, such as the electroreceptor in ionography. While tungsten and platinum are materials of choice for coronode wire in most positive charging applications, other materials may be used, and pepper tracking is observed with such materials to various degrees.

A.C. driven corona charging devices are known for various charging arrangements. Thus, for example, in charging processes requiring multiple charging functions, for charging a photoreceptor having an insulating overcoating, such as that shown in U.S. Pat. Nos. 4,565,436 to Okada et al and 4,339,783 to Kinashi et al, a secondary corona device is driven with an A.C. signal. Variations of the positive or negative portions of the A.C. signals driving these devices are shown for the purpose of obtaining greater uniformity in the multiple step charging process. Scorotron charging devices may also be driven with an A.C. signal to the coronode and a D.C. bias applied to the screen, as shown in U.S. Pat. Nos. 2,777,957 to Walkup; 2,879,395 to Walkup; 3,370,212, to Frank; and 3,390,266 to Epping. Corona charging devices driven with an A.C. signal, and having a D.C. bias level applied to the signal are taught in U.S. Pat. Nos. 3,076,092 to Mott; 4,456,365 to Yuasa; and Weber 4,306,271. The A.C. voltage signal may be rectified to provide a shaped wave to the corona wire, as shown in U.S. Pat. No. 3,800,154 to Tanaka.

SUMMARY OF THE INVENTION

In accordance with the invention, it has been found that the intermittent application of a negative polarity voltage signal to a positive charging D.C. corona device, while providing a net positive charging potential to a charge retentive surface, has the effect of "healing" the coronode wire defects. The intermittent negative polarity voltage signal may be derived from a negative D.C. voltage or an A.C. voltage signal having at least a portion of each cycle in a negative potential range. Continued application of such a signal over time inhibits the growth of defects on the coronode. Whatever the actual functioning of the process, pepper tracking defects are substantially reduced.

In accordance with another aspect of the invention, a positive charging corona device is driven with a voltage signal having a long duty cycle in the positive potential mode, and a relatively short portion of each cycle in the negative potential mode.

In accordance with another aspect of the invention, a negative D.C. voltage signal or an A.C. voltage signal having a negative polarity component may be applied to the coronode during selected periods of machine operation, which will not interfere with normal charging functions. Thus for example, the signals may be applied to the coronode during standby conditions, during the machine warm-up period from "OFF" or standby conditions and prior to copying or printing operation, during machine cycle-down periods prior to going to a standby condition, or during the interdocument period, between successive copying or printing operations.

It is therefore a primary object of the invention to provide a charging function for use with a bare wire coronode of a positive charging corona device for depositing a charge on a charge retentive surface which advantageously reduces the occurrence of pepper tracking during operations.

It is another object of the invention to provide an arrangement which allows a period of negative potential to be applied to the coronode, which has the effect of reducing pepper tracking, without otherwise affecting the charging functions in an electrographic device.

Figure 4:
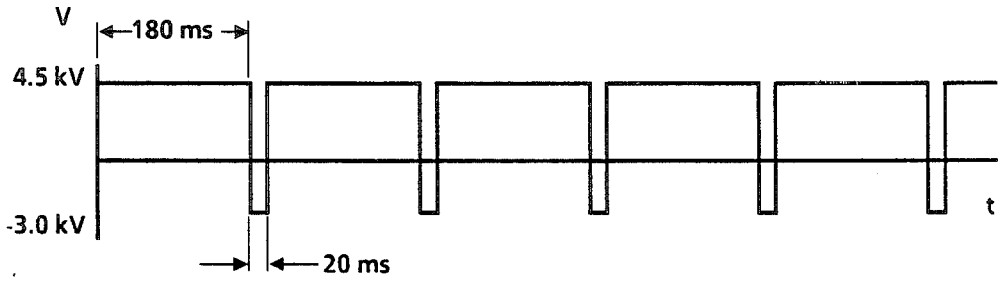
Figure 3:
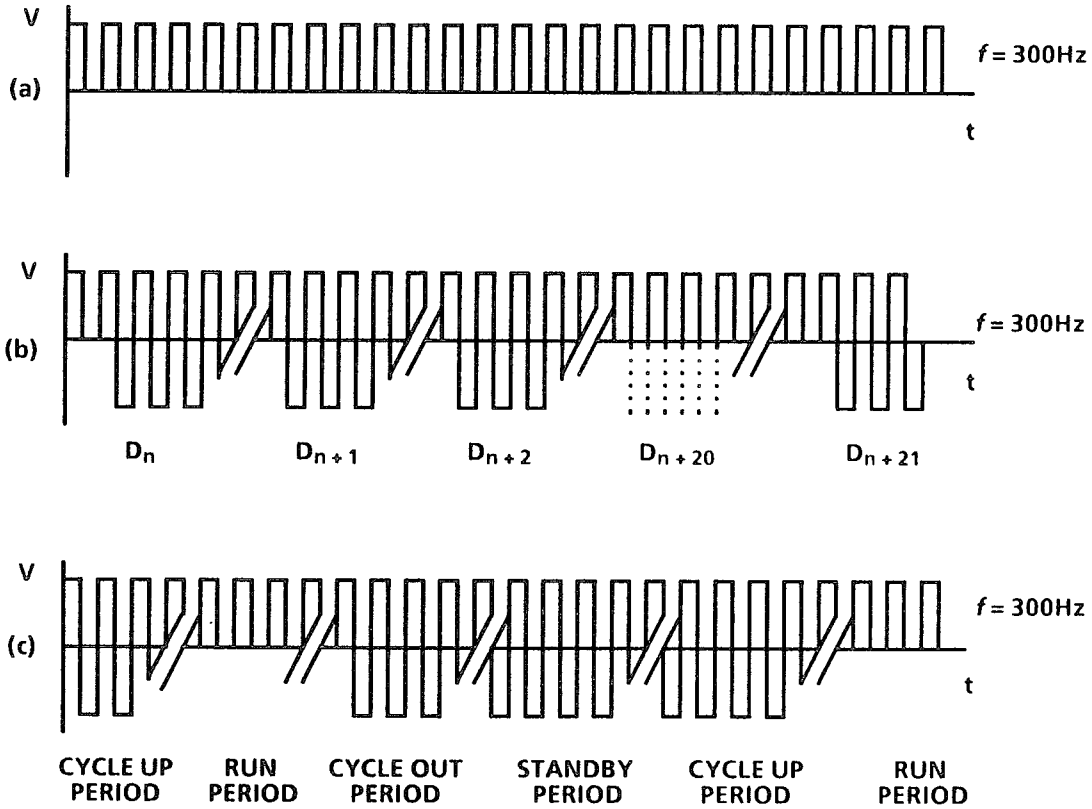

FIGS. 3 (*a*)-(*d*) are graphs of voltage applied to a corona charging device over time in accordance with the invention; and FIG. 4 is a graph of voltage applied to a corona charging device over time in accordance with another embodiment of the invention.

Figure 1:
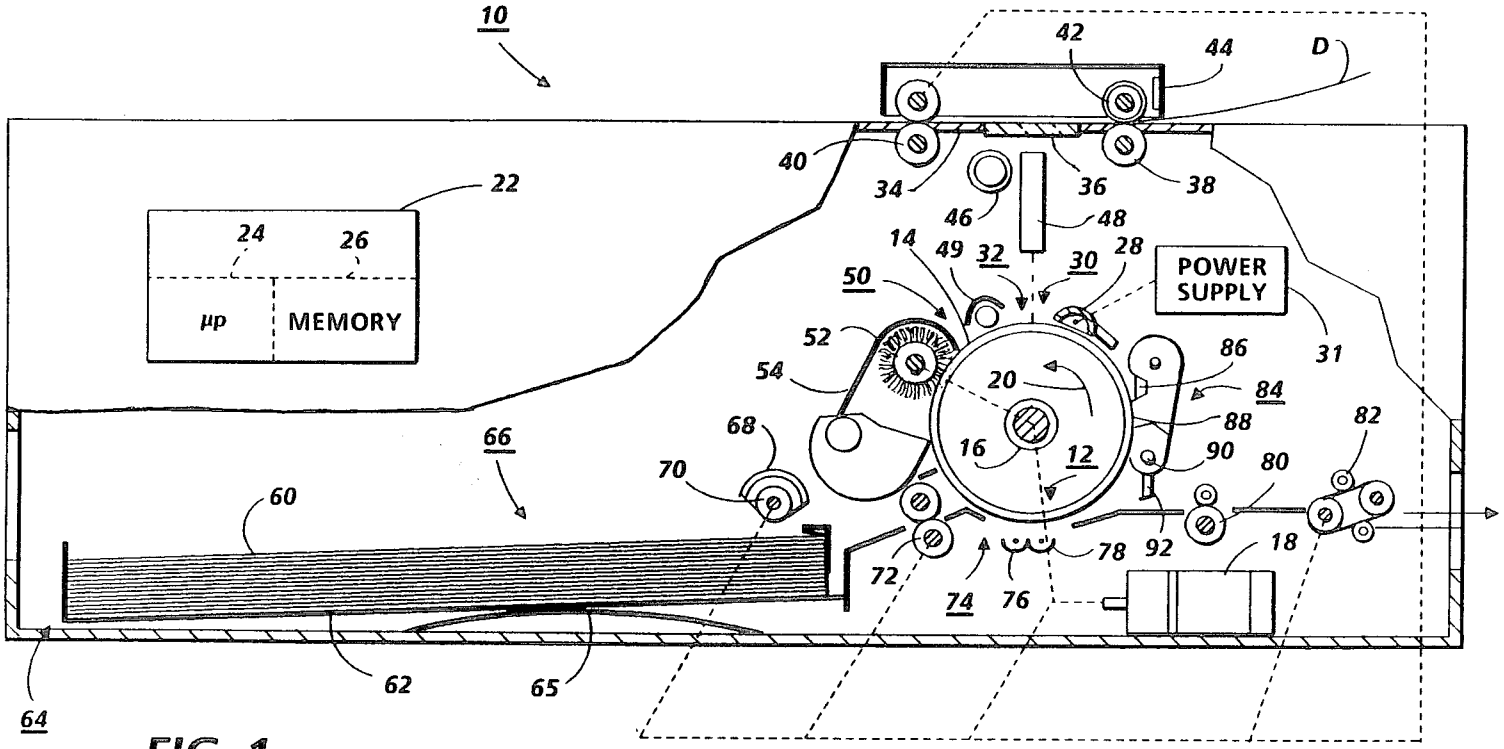
FIG. 1 is a side view depicting a xerographic reproduction machine of the type contemplated to incorporate the present invention.

Referring now to the drawings, wherein the showings are for the purpose of illustrating a preferred embodiment of the invention and not for the purpose of limiting same, FIG. 1 schematically depicts the various components of an illustrative xerographic device contemplated to incorporate the present invention. Inasmuch as the art of xerography is well known, the various processing stations employed in the FIG. 1 device will be shown hereinafter schematically and the operation described briefly with reference thereto. While the invention is described with respect to use in a xerographic reproduction machine, it will no doubt be appreciated that the invention finds similar applications in other electrographic processes, such as inography, where the charge retentive surface of an electroreceptor is positively charged. Additionally, while the embodiment will describe the invention with respect to a corotron, the invention is equally applicable to scorotrons and other positive charging devices.

As shown in FIG. 1, a reproduction machine 10 for copying documents has an image recording photoreceptor 12 in the form of a drum, the outer periphery or surface 14 of which is provided with a photoconductive insulating material of selenium or its alloys. Photoreceptor 12 is supported for rotation within the machine frame (not shown) on shaft 16. A main drive motor 18 is drivingly coupled to photoreceptor 12, for rotation in the direction indicated by arrow 20, to bring photoconductive surface 14 past a series of xerographic processing stations. A controller 22, including microprocessor 24 and memory 26, is provided for operating in predetermined timed relationship the various components that comprise machine 10 to reproduce a document upon a sheet of final support material such as a copy sheet. Controller 22 is preferably a known programmable controller or combination of controllers, which conventionally controls all of the machine steps and functions described herein and including the operation of document feeders, the paper path drives, and other machine operations. Controller 22 with microprocessor 24 and memory 26 also conventionally provides for storage and comparisons of counted values including copy sheets and documents, and numbers of desired copies, and control of operations selected by an operator.

Initially, photoconductive surface 14 of photoreceptor 12 is uniformly charged by a positive charging device such as corotron 28 at charging station 30. Corotron 28 is driven by a high voltage D.C. power supply 31, which supplies a positive potential for uniformly charging photoconductive surface 14, as will be explained further hereinbelow. The uniformly charged photoconductive surface 14 is exposed to light at exposure station 32 to selectively dissipate charge and create a latent electrostatic image of a document on photoconductive surface 14. For this purpose, a supporting surface or platen 34 for supporting documents D is provided having a scan aperture or slit 36 therethrough. A document transport, depicted herein as inlet and outlet constant velocity roll pairs 38 and 40, is provided for transporting document D past scan slit 36. Roll pairs 38 and 40 are drivingly coupled to main drive motor 18. Roll pair 32 is controllably coupled to main drive motor 18 through electromagnetically operated clutch 42. A document sensor 44 is provided at the inlet to platen 34 for sensing the insertion of documents to be copied and initiating operation of reproduction machine 10.

A lamp 46 disposed below platen 34 serves to illuminate scan slit 36 and the line-like portion of document D thereover. A fiber optic lens array 48 which may, for example, comprise an array of gradient index fiber elements, is provided to optically transmit light reflected from the line-like portion of the document being scanned to photoconductive surface 14 at exposure station 32. It will, of course, be appreciated that a similar function is accomplished by an electronic printer employing a laser driven in accordance with an electronic image stored in memory to selectively dissipate charge from a photoconductive surface.

The charged area surrounding the latent image of the document, as well as the area between successive latent images on photoconductive surface 14 may be discharged by interdocument/edge erase lamp 49. Discharging these areas prevents unnecessary development of the non-exposed areas of the photoreceptor, thereby saving toner material, and preventing the appearance of undesirable lines at the edges of the copy sheets upon development. Interdocument/edge erase lamp 49 is controllably operated in accordance with the need to discharge the interdocument areas or the edge areas by controller 22.

Following exposure, the latent image on photoconductive surface 14 is developed at a development station 50. There, a developer such as magnetic brush roll 52, which is drivingly coupled to main drive motor 18, brings a developer mix in developer housing 54 into developing relation with the latent image to develop the image and render the same visible.

Copy sheets 60 are supported in a stack on base 62 of copy sheet supply tray 64. A biasing arrangement is provided, such as spring member 65 arranged below tray 64, to raise base 62 of tray 64 and bring the topmost copy sheet in the stack of copy sheets 66 into operative relationship with segmented feed rolls 68. Feed rolls 68, driven by main drive motor 18 through electromagnetically operated clutch 70, serve to feed the topmost copy sheet into the nip of a registration roll pair 72, which register the copy sheet with the image on the photoconductive surface 14 of photoreceptor 12. Registration roll pair 72 advance the copy sheet to transfer station 74. There, a transfer/detack arrangement such as transfer/detack corotrons 76 and 78 bring the copy sheet into transfer relation with the developed image on photoconductive surface 14 and separate the copy sheet with the toner therefrom for fixing and discharge as a finished copy.

Subsequent to receiving the developed image, the copy sheet is transported to fuser 80, which may, for example, comprise a radiant-type fuser, where the image is permanently fixed to the copy sheet. Following fusing, the finished copy is transported by roll pair 82 to a receptacle such as an output tray (not shown) or to a finishing area for stapling, binding, collating, etc. Registration roll pair 72 and transport roll pair 82 are driven by main drive motor 19 through driving means such as belts and pulleys.

Following transfer, residual developer remaining on the photoconductive surface 14 is removed at cleaning station 84 with cleaning blade 86. Cleaning blade 86 is supported in contact with the photoconductive surface 14 such that residual toner is chiseled therefrom. Developer removed by blade 86 is deposited into a collector 88 for removal. Auger 90 may be used to move toner and debris through collector 88 to a conduit 92, through which toner and debris are removed to a storage receptacle for eventual removal from the system.

While a drum type photoreceptor is shown and described herein, it will be understood that other photoreceptor types may be employed such as belt, web, etc.

To permit effective and controlled charging of photoconductive surface 14 by corotron 28 to a predetermined level necessitates that any residual charge on the photoconductive surface 14 or trapped in the photoreceptor be removed prior to charging. An erase device 94 is provided for this purpose.

Figure 2:
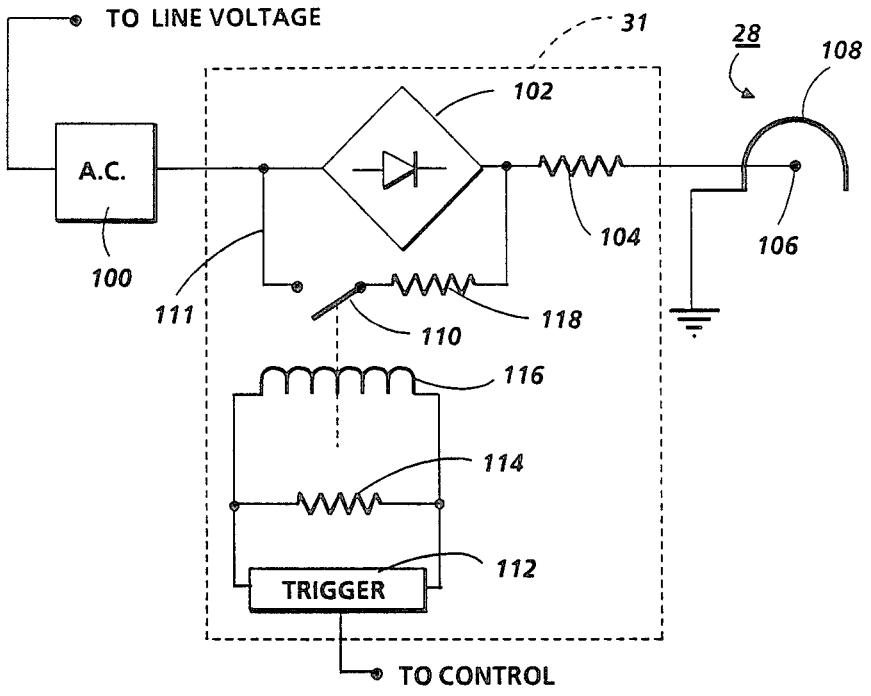
FIG. 2 is a schematic diagram of a D.C. power supply for driving a corona charging device, suitable for use with the present invention.

With reference now to FIG. 2, in a preferred embodiment of the invention, high voltage D.C. power supply 31 may be used for driving the corotron to charge the photoreceptor to a desired positive potential and providing a periodic negative voltage signal for healing streamer sites associated with pepper tracking. An A.C. high voltage source 100, such as a transformer, provides a high voltage A.C. signal to power supply 31 from a line voltage source. The A.C. signal is rectified through rectifier 102 to provide a half wave rectified A.C. potential across the load impedance 104 to the wire coronode 106 of charging corotron 28. Coronode 106 generally is a bare tungsten wire which through processing to a desired smoothness, flexibility and tensile strength, may have a surface oxidation to a depth of approximately 0.5 to 2.0 microns. The tungsten wire is cleanable, does not lose strength over time, and is reasonably priced. Accordingly, it is a desirable material of choice in use for coronodes. Other materials including platinum and its alloys may also be suitable coronodes, and benefit from the present invention. Corotron shield 108 is connected to a low potential or ground. As suggested in the graph of voltage versus time in FIG. 3(*a*), in a typical application of such a power supply, a half wave rectified A.C. signal of approximately 5.0 kilovolts may be applied to the coronode to effect positive charging of the photoreceptor. This value will, of course, vary in accordance with the charging requirements of any particular device.

With reference again to FIG. 2 and in accordance with one possible embodiment of the invention, power supply 31 is controllable to periodically deliver a negative voltage signal across coronode 106 without interference to the charging function of corotron 28. In the embodiment shown in FIG. 2, a reed relay switch 110 is provided in a circuit path 111 across rectifier 102 to load impedance 104. Relay switch 110 is normally in an open state, allowing the A.C. voltage signal from A.C. high voltage source 100 to pass through rectifier 102 for rectification to a half wave rectified signal for normal charging operation, as shown in FIG. 3(*a*). Trigger 112, in combination with load resistance 114 and inductor 116, closes relay switch 110 in response to a control signal to trigger 112, whereby the A.C. high voltage signal from A.C. high voltage source 100 is permitted a path through 111 and relay switch 110 to pass unrectified through load impedance 104 to coronode 106. Trigger 112 allows relay switch 110 to close for a period long enough to allow at least one cycle of the A.C. voltage signal to pass through coronode 106. In this manner, the coronode sees the negative voltage portion of at least one cycle of the A.C. voltage signal. In a typical embodiment, an A.C. voltage signal of about 300 Hertz is utilized with a switching period of about 300 milliseconds. The switching period is dictated by the specific embodiment, and the scheme used to apply the negative voltage signal across the coronode.

Trigger 112 is controllable in a number of ways to provide switching for the application of the A.C. voltage signal to coronode 108. In one embodiment of the invention, control of trigger 112 may be tied to control of the interdocument/edge erase lamp 49. As represented in FIG. 3(*b*), for each interdocument space $D_n$ passing by the corotron, the same control signal from controller 22 that energizes interdocument/edge erase lamp 49 to discharge the charged area between latent images on photoconductive surface 14 also energizes trigger 112 to allow a negative voltage signal to be applied to coronode 106 while an interdocument area is adjacent corotron 28. Accordingly, the negative voltage signal may be frequently applied to coronode 106 in a manner having no effect on the charging function. In a similar arrangement, the trigger may be controlled directly from the controller to apply a negative voltage to coronode 106 without reference to the interdocument/edge erase lamp, but corresponding to the interdocument areas. One problem associated with this arrangement is that the interdocument area may also be used to monitor the charge level on the photoreceptor and/or the developed image density. In a typical embodiment, a patch of the interdocument area is charged and developed periodically, and examined with an infrared detector (IRD), which senses the density of toner developed on the patch. Alternatively, an electrostatic voltmeter (ESV) may periodically sample the voltage on the photoconductive surface in the interdocument area. Such tests are usually only performed intermittently on a single copy cycle out of many. Since application of a negative voltage to the coronode during the charging of the interdocument area during a test would have an adverse effect on the development of feedback to the charging controls or to the development system from either an IRD or an ESV, the negative voltage signal should not be applied to the corotron during these test cycles as suggested by the phantom lines of the cycle labeled $D_{nt20}$.

In yet another embodiment of the invention, and as suggested by FIG. 3(*c*), control of trigger 112 to apply the negative voltage signal to the coronode is tied to control of the power up and power down sequence in the machine, preparatory and subsequent to operation of a copying machine for a job. When the machine is in an "OFF" condition before the device is turned on, or in a standby condition, during periods of inactivity, the machine may require a warm-up period prior to copying operations. This period may allow the fuser to warm up, for voltages to rise to acceptable levels, for the controller to initialize operations, etc. During this time, as part of the warm-up or cycle-up operations, the controller may direct trigger 112 to close, to apply the A.C. voltage signal to the coronode. Subsequent to cycle-up, during operation or run periods, trigger 112 is opened and the rectified A.C. signal drives the coronode to charge the photoconductive surface 14. A similar function may be applied when the machine goes from a run period through a cycle-out period to a standby condition. The negative voltage signal may be applied constantly or for several times during the cycle-out or standby non-operational periods, without effect on the charging functions of the machine. The photoreceptor will normally be rotating during application of the A.C. or negative D.C. signal to the coronode to prevent damage to the photoreceptor. In the case of a negative D.C. signal, it is desirable that the erase function also be activated to ensure that the photoreceptor is not overcharged.

In another embodiment of the invention, power supply 31 provides a periodic negative voltage signal to the coronode. A charging function signal is directed to the coronode having a long positive duty cycle and a relatively short negative signal portion, as shown in FIG. 4. Charging uniformity may be disadvantageously affected by the application of this signal by the appearance of a strobing condition, if the period of one charge cycle is comparable to the time of transit of each point on the photoconductive surface beneath the corotron. To avoid the problem of strobing, the charging function frequency is chosen such that each point on the photoreceptor is charged over multiple cycles of the signal during the charging operation. In this manner, there is a high degree of charge averaging and smoothing. It is desirable for any point to be exposed to several cycles of the signal, and in the described embodiment, an exposure to the charging function of greater than approximately 50 cycles results in satisfactory charging uniformity. Below this period, strobing will begin to appear, while above this period, the signal will smooth itself out. As an example of the switching frequency required to achieve this function, a reproduction machine operable at 10 copies a minute, with a photoreceptor moving at a speed of approximately 1.5 to 2.5 inches per second, and charged with a corotron one inch wide, would require a minimum frequency of about 75–125 cycles per second. As the speed of the machine increases, the frequency of the signal must increase.

In one actual test of the embodiment described with respect to FIG. 4, a first standard D.C. driven corona producing device was observed in comparison to a second corona producing device driven with a voltage signal demonstrated in FIG. 4, having a positive voltage of approximately 4.5 kV and a period of about 180 msec. and a negative voltage of about 3.5 kV and a period of about 20 msec. Power for each device was derived from a Trek Cor-a-trol Model 610A power supply. The corona producing devices, each provided with a tungsten wire coronode, were driven to corona producing conditions while supported closely adjacent to silicon oil vapor source. After a period of about two hours, hot spots were noted on the first D.C. driven coronode, while an even corona glow was maintained on the second coronode driven with the periodic negative voltage signal. Subsequently, the voltage function driving the second coronode was varied to reduce the amount of applied negative voltage to about 1.0 kV. After a period of time, hot spots and streamers were observed on the second coronode. The voltage signal was returned to the original function, and, after approximately an hour, the second coronode healed, and hot spots and streamers were no longer noted.

It will no doubt be appreciated that the described embodiment is only one possible arrangement to achieve the desired result. Thus, it is well within the scope of the invention to provide an arrangement which disengages the coronode from the positive D.C. power supply and directs a negative pulse derived from the A.C. voltage signal or another power supply in the machine to the coronode for the requisite period. Alternatively an asymmetrical A.C. square wave voltage signal may be provided to the coronode, providing both positive and negative polarity components, and depositing a net positive charge on the photoconductive surface. Other arrangements of timing the application of the negative voltage signal with respect to the imaging process are also well within the contemplation of the invention, as are combinations of the above embodiments. It is intended that all such modifications and alterations are included insofar as they come within the scope of the appended claims or equivalents thereof.

We claim:

1. In an electrographic device wherein a corona charging device having a bare wire coronode is driven with a positive D.C. voltage signal to deposit a net positive charge on a charge retentive surface in a single charging step prior to exposure of said charge retentive surface to imaging radiation, a method for preventing pepper tracking is provided comprising:

periodically driving the corona charging device with a negative voltage signal, whereby defects in said bare wire coronode causing pepper tracking are healed.

2. The method as defined in claim 1 wherein said charging device is driven with said negative voltage signal during interdocument periods.

3. The method as defined in claim 1 wherein said corona charging device is driven with said negative voltage signal during a device cycle-up period.

4. The method as defined in claim 1 wherein said corona charging device is driven with said negative voltage signal during a device cycle-down period.

5. The method as defined in claim 1 wherein said corona charging device is driven with said negative voltage signal during a device stand by period.

6. In an electrographic device wherein a corona charging device having a bare wire coronode is driven with a positive D.C. voltage to deposit a net positive charge on a charge retentive surface in a single charging step prior to exposure of said charge retentive surface to imaging radiation, a method for preventing pepper tracking is provided comprising:

periodically applying an alternating polarity voltage signal to said wire coronode, said alternating polarity voltage signal including a negative polarity voltage signal portion, whereby defects in said wire coronode causing pepper tracking are healed.

7. The method as defined in claim 6 wherein said coronode is driven with said alternating polarity voltage signal during interdocument periods.

8. The method as defined in claim 6 wherein said coronode is driven with said alternating polarity voltage signal during a device cycle-up period.

9. The method as defined in claim 6 wherein said coronode is driven with said alternating polarity voltage signal during a device cycle-down period.

10. The method as defined in claim 6 wherein said coronode is driven with said alternating polarity voltage signal during a device stand by period.

11. In a xerographic device, wherein a corona charging device having a bare wire coronode is driven with a rectified A.C. voltage signal to deposit a net positive charge on a charge retentive surface in a single charging step prior to exposure of said surface to imaging radiation, a method for preventing pepper tracking is provided comprising:

periodically applying an alternating polarity voltage signal to said wire coronode, said alternating polarity voltage signal including a negative polarity voltage signal portion, whereby defects in said wire coronode causing pepper tracking are healed.

12. The method as defined in claim 11 wherein said alternating current signal is applied to said coronode during interdocument periods.

13. The method as defined in claim 11 wherein said coronode is driven with said non-rectified A.C. voltage signal during a device cycle-up period.

14. The method as defined in claim 11 wherein said coronode is driven with said non-rectified A.C. voltage signal during a device cycle-down period.

15. The method as defined in claim 11 wherein said coronode is driven with said non-rectified A.C. voltage signal during a device stand by period.

16. A charging arrangement in an electrographic device wherein a corona charging device having a wire coronode is driven with a D.C. voltage signal to deposit a net positive charge on a charge retentive surface in a single charging step prior to exposure of said charge retentive surface to imaging radiation, and including an arrangement for the reduction of streamer formation, comprising:

an A.C. high voltage source providing an A.C. voltage signal having at least a portion of each A.C. cycle of negative polarity;

a rectifier for rectifying said A.C. voltage signal to provide a D.C. voltage signal driving the corona charging device to deposit a net positive charge on the photoconductive surface;

a circuit path from said A.C. high voltage source to said coronode to provide an non-rectified A.C. voltage signal to drive said coronode;

a switch in said circuit path, in a normally open condition, for selectably completing said circuit path from said A.C. high voltage source to the coronode when closed; and control means for selectably closing said switch connecting said circuit path from said A.C. high voltage source to the coronode, for a period allowing a negative polarity to be applied to said coronode.

* * * * *